United States Patent [19]

Föhl

[11] 4,022,998

[45] May 10, 1977

[54] ACCELERATION AND RETARDATION RESPONSIVE ELECTRIC CONTROL DEVICE

[76] Inventor: Artur Föhl, Schelmenwasenstr. 68, 7061 Haubersbronn, Germany

[22] Filed: Apr. 17, 1975

[21] Appl. No.: 569,096

Related U.S. Application Data

[62] Division of Ser. No. 368,972, June 11, 1973, Pat. No. 3,927,286.

[30] Foreign Application Priority Data

June 13, 1972 Germany ..... 2228683

[52] U.S. Cl. ..... 200/61.45 R; 200/61.52; 200/DIG. 29

[51] Int. Cl.[2] ..... H01H 35/14

[58] Field of Search ..... 200/1 R, 61.45 R, 61.48–61.52, 200/61.53, DIG. 29, 293–296

[56] References Cited

UNITED STATES PATENTS

| | | | |
|---|---|---|---|
| 1,662,979 | 3/1928 | Nelson | 200/DIG. 29 UX |
| 2,182,300 | 12/1939 | McCandless | 200/61.52 |
| 2,892,049 | 6/1959 | Rubinstein | 200/61.52 X |
| 2,926,223 | 2/1960 | Netterfield | 200/61.52 |
| 3,601,729 | 8/1971 | Hierta | 200/61.52 X |
| 3,621,163 | 11/1971 | Hitchcock | 200/61.45 M |
| 3,731,019 | 5/1973 | Heurtebise | 200/61.45 R |
| 3,733,448 | 5/1973 | Brady | 200/61.52 X |
| 3,748,415 | 7/1973 | Suzuki | 200/61.52 X |
| 3,769,472 | 10/1973 | Bell et al. | 200/61.52 X |
| 3,812,308 | 5/1974 | Bell et al. | 200/61.52 |
| 3,889,774 | 6/1975 | Schwenk | 200/61.52 |
| 3,927,286 | 12/1975 | Fohl | 200/61.52 |

*Primary Examiner*—James R. Scott
*Attorney, Agent, or Firm*—Walter Becker

[57] ABSTRACT

A device responsive to acceleration in any direction in which a ball rests on an upwardly facing seat in a housing and is movable laterally on the seat when acted on by a predetermined force of acceleration. When the ball moves laterally on the seat an electric circuit is completed which can be employed for signalling or control purposes.

11 Claims, 3 Drawing Figures

ACCELERATION AND RETARDATION RESPONSIVE ELECTRIC CONTROL DEVICE

This is a division of application Ser. No. 368,972-Fohl filed June 11, 1973, now U.S. Pat. No. 3,927,286-Fohl, issued Dec. 16, 1975.

The present invention relates to an acceleration and retardation responsive electric control device which is intended preferably for installation in vehicles, especially motor vehicles, airplanes, ships, and the like, and which is provided with a ball acting as mass inertia body and movable from its stabile rest position to different sides when the acceleration or retardation exceeds a predetermined fixed minimum value, the control device cooperating with at least one electric contact which is arranged in spaced relationship to the ball when the latter is in its rest position.

Control devices of this type are frequently employed for quickly and safely initiating the winding-up of automatic systems of safety belts in case of danger when the vehicle which is equipped with such safety belts is subjected to a certain limit acceleration or retardation. Devices of this type are frequently called sensors.

It is an object of the present invention to provide a simple and safely operating control device of the above mentioned general character in which the limit value of acceleration or retardation is adjustable at which the control operation is to be initiated.

It is a further object of this invention to realize a control device as set forth in the preceding paragraph in which the control function will equally will be assured in all directions in the horizontal or at least approximately horizontal plane.

A still further object of the present invention consists in that when the device according to the invention is fixedly installed in motor or rail vehicles, the device will, when the vehicle is driven over inclines or in inclined position, not show any material deviation as to its control precision over situations in which the vehicle is driven on horizontal planes.

These and other objects and advantages of the invention will appear more clearly from the following specification in connection with the accompanying drawings, in which.

Figure 1:
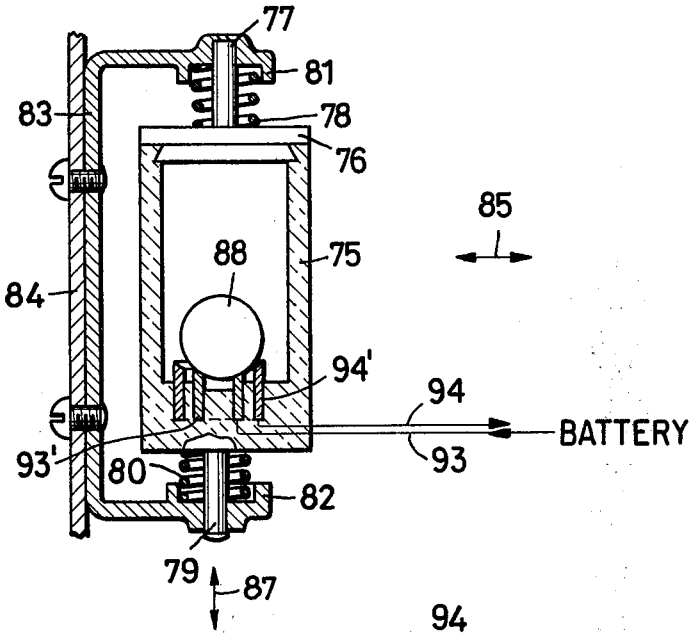
FIG. 1 shows another control device according to the invention which is connected in a cushioning and/or resilient manner.

As numerous tests have shown, in case of a collision between vehicles it is always of foremost importance that the safety device in such vehicles respond in a minimum of time. Collision sensors have become known in which the mass inertia body in the form a ball is in its starting position subjected to the thrust of a spring. In practice, however, such control devices have shown the drawback that their response precision is not sufficient because it depends too much on the influence of the spring force.

Moreover, when manufacturing such devices, it is difficult so precisely to tune such springs that only minor deviations from the desired limit value of acceleration or retardation will occur.

The above mentioned drawbacks have been overcome by the acceleration and retardation responsive control device according to the invention which is characterized primarily in that the ball in its rest position rests upon the confining edges of a cutout which edges extend at least approximately in a horizontal plane, while the cutout is designed with a radius determining the engaging depth of the ball, this radius being smaller than that of the ball. With such an arrangement, the ball extends in its rest position with a downwardly pointing spherical section into the cutout. Out of this stable rest position the ball can be lifted and moved toward the side, in view of its mass inertia force, only when an acceleration or retardation is exerted upon the support containing the cutout which acceleration or retardation exceeds the limit value derived from the dimensions of the ball and the dimensions of the cutout. For this limit value there exists the relationship according to which the product of ball weight and radius of the cutout must equal the product of the mass of the ball, the acceleration or retardation and the vertical distance of the center of gravity of the ball and the plane passing through the confining edges. This will precisely furnish the control resolution of the control device. Particularly stable conditions will be obtained when, according to a further development of the invention, the radius of the cutout amounts to 30% of the ball diameter, the vertical distance of the center of gravity of the ball amounts to 30% of the ball diameter. The control resolution lies in this instance at an acceleration or retardation of 75% of the acceleration due to gravity.

When the limit value derived from the geometry of the ball and of the cutout is exceeded, the ball moves out of its rest position and rolls towards the outside from the center of the cutout. On its way toward the outside, the ball can carry out a mechanical or electric control function. A safe and proper control function can be realized with simple means when, according to a further development of the invention, a metallic supporting member is provided which contains the cutout and when the supporting member is connected to a source of current. When in this connection the ball has a metallic conductive surface, it will in view of its engagement with the metallic confining edges likewise receive voltage. Expediently, the supporting member may be designed as a ring or as a tube, and the cutout intended for partially receiving the ball may be formed by the bore of the ring or of the tube. A particularly simple and effective control arrngement is obtained when as control contacts, according to a further development of the invention, there are provided two concentric rings insulated with regard to each other. Expediently, between these two concentric rings there is arranged a tube section of insulating material which tube section has its end face which faces the ball ending at a slight axial distance below the end faces of the two rings so that between the two rings there is formed a groove. When due to horizontal acceleration or retardation the ball is lifted out of its rest position because the control resolution has been exceeded, the ball will roll radially outwardly and will establish an electrically conductive connection between the two concentric rings which consist of metal or have a metallic cover. This operation practically corresponds to a pulse control operation with closing contacts. Inasmuch as it is structurally possible without difficulties to obtain very short distances, the control retardation can be fixed for very small values. If the end face of the inner ring toward the ring axis is provided with an inclination which corresponds to the conditions encountered by the vehicle when driving uphill or downhill, it will be appreciated that, when a distinct resting point for the stable starting position of the ball is provided which resting point determines the control resolution, the limit values for the acceleration and retardation vary in conformity with the cosine value of the angle of inclination and thus can be practically neglected for small angles of inclination.

When the two rings acting as contacts are provided with end faces which are perpendicular to their axes and which extend in a common horizontal plane, the mass ball will not be able, after it has been controlled out of its starting position, to return to its starting position without outside help but will remain in its control position in which the ball engages the groove between the two rings. This so to speak bi-stable behavior may be disturbing in such instances of application of the control device in which a contact is desired only as long as the acceleration or retardation exceeds the adjusted or set limit value. To make sure that the ball will, after effected control, automatically return to its starting or rest position, the end face of at least one of the rings, preferably of the inner ring, may, according to an advantageous design of the device according to the invention, form the mantle of a cone which is coaxial with the ring and which has the point of the cone directed downwardly. In this connection, the line of intersection of the end face and of the bore will be located at the outer ring on the conical mantle, and the radial width of the groove between the two rings will be sufficiently small. Expediently, walls may be provided outside the outer contact ring which walls limit the stroke of the ball radially toward the outside. The angle at which the mantle surface of the cone is inclined toward the horizontal plane is advantageously selected slightly smaller than the angle of inclination which the ball will still be able to overcome after it has been lifted out of its stable rest position due to the force of acceleration. In this way it will be assured that the ball will be able, after it has been lifted out of the cutout, to roll toward the outside until contact is established.

When installing a control device according to the present invention in vehicles which, in addition to the acceleration or retardation in approximate horizontal plane, are also subjected to shock-like accelerations acting perpendicularly with regard to this plane, additional steps might be necessary for the mass ball in order to stabilize the same in vertical direction. This can be realized in a simple manner according to the present invention by arranging a shock-absorbing or cushioning element which acts in a vertical direction and which is arranged above the ball when the latter is in its rest position, said cushioning element acting upon the ball by its weight. In this way it can be realized that with acceleration shocks acting in a vertical direction, the ball is held in the cutout acting as contact resolution. Expediently, such cushioning element may consist of synthetic material. In particularly difficult instances, very short vibrations may occur in vertical direction which make it necessary to provide a cushioning element adapted to perform an increased cushioning operation. This can be realized according to a further development of the invention by designing the cushioning element as a sleeve and closing the same at its lower section by a bottom on which the ball rests. Expediently, in the interior of the sleeve, small balls of synthetic material, or steel may be filled in which in response to a corresponding acceleration shock exert a friction upon each other and thereby consume working energy so that with this consummation of energy, the mass ball is safely held in its stable starting position in the cutout of its support, namely, the bottom of the sleeve. According to a preferred embodiment of the invention, the bottom serving as support for the ball may consist of a cushioning material, for instance, of synthetic material. Furthermore, the said bottom may contain a central ring or tube section acting as contact surface and may also contain a lining of insulating material, which lining is arranged within said ring and has a central longitudinal bore which forms the cutout for the ball. In this way it can be realized in a simple manner that also which increased vertical accelerations, the ball will always safely remain in its starting position without carrying out control operation and will only in response to correspondingly high acceleration values or retarding values leave its support on the lining when, for instance, an accident occurs.

According to a further suggestion in conformity with the present invention, a liquid medium may, for increasing the cushioning effect, be introduced into the chamber which receives the mass ball. As liquid medium in this instance there is employed a medium which has no electric conductivity as, for instance, transformer oil. When the chamber surrounding the ball is filled with oil, the static pressure of the liquid will act above the ball and also the dynamic cushioning in view of the viscosity of the liquid will be effective. The ball will in this way be pressed into the cutout in the supporting surface or supporting body therefore, and will undergo a high cushioning in case shocks occur in vertical direction. This shock absorbing effect depends to a great extent on the viscosity of the employed liquid. The reduced control speed resulting therefrom during horizontal acceleration and retardation may be disadvantageous in various instances of application. For purposes of increasing the control speed and for avoiding control sparks or arcs during the establishment and interruption of contacts, it may be advantageous in conformity with a further development of the invention with the design described above to greatly evacuate the chamber surrounding the ball so that preferably an absolute pressure of 100 Torr or less is obtained. Advantageous, with regard to the sine curve, is an inner pressure of approximately 10 Torr which can relatively easily be maintained and over a normal atmospheric pressure brings about the advantage that only at considerably increased voltages, sparkovers or light arcs may occur at the contacts of terminals. According to a further suggestion in conformity with the present invention, a permanent magnet may be arranged in the bore on the confining edges of which the mass ball rests. The ball which has a cover layer of ferromagnetic material, or which consists of ferromagnetic material will then be attracted by the permanent magnet.

While using the principle of the invention above referred to, it is additionally possible above the mass ball to provide a pressure plate which is mechanically connected to a micro-switch. This micro-switch is actuated when the mass ball leaves its cutout defining the stabilizing starting position of the ball, and is lifted upwardly. According to a further development of the invention, a permanent magnet may be arranged above the ball which will act as cushioning element and which, in response to exceeding the limit acceleration, is lifted off the mass ball to such an extent that a reed contact arranged above the permanent magnet will be moved into its closing or turning-on position. Moreover, this is also possible according to a further development of the invention by employing a magnet which is arranged above the ball and is operatively connected thereto, and by controlling by means of said magnet a so-called field plate and to initiate by the latter a fast control action. According to a still further development of the invention, it is possible instead of the above described permanent magnet, to provide a soft iron core which immerses at its upper end section into an induction coil. When this mass ball is controlled in the above mentioned manner and lifts the soft iron core, there will in this instance, a change of induction occur, by means of which it is possible safely and quickly to obtain a control pulse in a manner known per se. Finally, according to the invention it is also possible for cushioning the mass ball to provide a cushioning element of the type of a brush holder which is under vertical spring force and which is provided with a cable connection that will assure that the ball in response to the limit value of a horizontal acceleration or retardation gets into contact with a radially spaced ring zone, thereby carrying out the control function.

When installing a device according to the invention in a motor vehicle, the following conditions will result. When the vehicle drives straight ahead, and when the fixed acceleration or retardation value is exceeded, a signal will be emitted which brings about, for instance, the blocking of the rolling-up kinematics for the provided safety belts. When the vehicle drives through curves at high speed, the mass ball will, due to the centrifugal force acting thereupon, be lifted out of its rest position and will move outwardly whereby likewise a contact will be closed. If however, it is desired that the device should not respond, for instance, when driving through a bank or canted curve, there exists the possibility so to design the supporting edges for the ball that the control device will not respond as long as the critical centrifugal force has not been reached. It is thus possible within the horizontal plane of function, to set or determine a desired acceleration or retardation value at which the device will respond.

Advantageously, the supporting member for receiving the ball may be produced by injection molding or pressing for which purpose no complicated or expensive tools are required.

The forces which act in a direction perpendicular to the acceleration plane, and which may subject the mass ball to oscillations, can be absorbed by suspending the entire sensor system in a resilient or elastic manner in the vehicle approximately perpendicularly with regard to the vehicle plane. Any possible influence exerted upon the mass ball which may be produced by the cushioning elements depending on their arrangement need no longer be taken into consideration. Therefore, by a clear calculation, the corresponding supporting position for the mass ball can be predetermined.

A suspension of the type referred to in the preceding paragraph is illustrated in FIG. 1. According to FIG. 1, the sensor housing 75 is closed by a cover 76. Arranged on the cover 76 is a guiding pin 77 for receiving a pressure spring 78. At the bottom of the sensor there is likewise provided a guiding pin 79 for receiving and guiding a pressure spring 80. The pressure spring 80 is, in a dish-shaped manner, held in a supporting cap 81, and the pressure spring 80 is held in a supporting cap 82. The supporting caps 81 and 82 are connected in a U-shaped manner to the web 83 which is firmly connected to the vehicle 84. In the driving direction indicated by the arrow 85 which driving direction simultaneously illustrates the acceleration plane and the plane in which the device responds, the device must not carry out any relative movement with regard to the vehicle. Perpendicularly to this plane in the direction of the arrow 87, the complete device is resiliently supported by pressure springs 78 and 80 to cushion any oscillations so that the mass ball 88 when the vehicle drives through holes in the road will safely remain in its supporting position without the necessity of providing inner cushioning elements.

Figure 2:
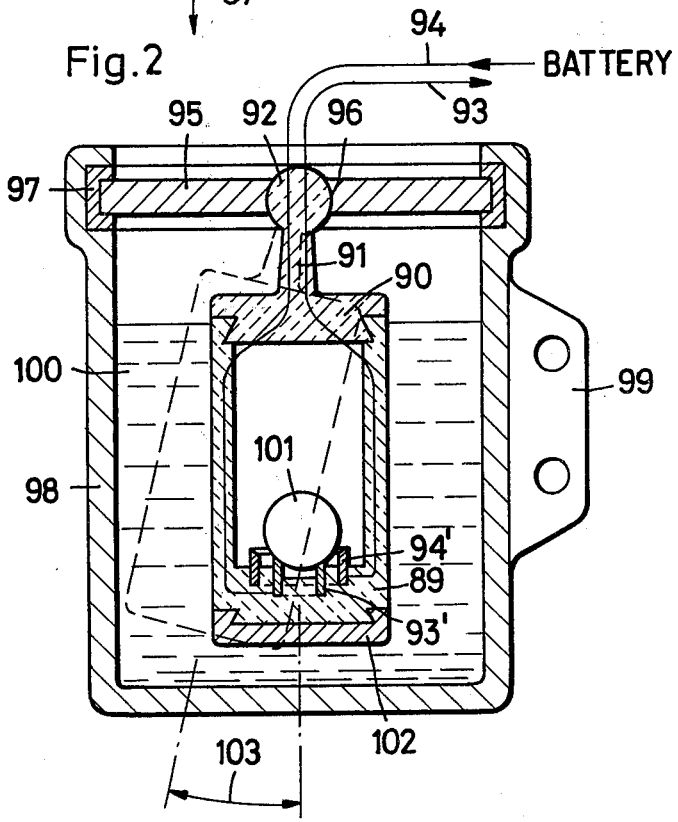
FIG. 2 represents still another control device according to the invention with an oscillation cushioning suspension, the device being shown as a vertical section.

FIG. 2 shows a further development of the design according to the invention in which the suspension and outer cushioning means are particularly favorably designed. The sensor housing 89 is principally of the same construction as described. Merely the length is somewhat greater. At its open top side the sensor housing 89 is closed by means of a snap cover 90 which consists of rubber elastic material, especially synthetic material, such as polyvinylchloride. The cover 90 has its top side a neck 91 and merges with a ball head portion 92. The connecting lines 93 and 94 electrically joined to contacts 93' and 94' respectively are flexible and pass toward the outside through the ball head portion 92. A bearing plate 95 has in its center a spherical supporting surface 96 for pivotally journaling the sensor. The bearing plate 95 is in a resilient cushioning element 97 advantageous embraces the bearing plate 95 in a U-shaped manner. This cushioning housing may, by means of an element 92 be fixedly connected to the vehicle. The cushioning housing 98 contains a cushioning liquid 100. Due to this arrangement, the sensor will, during the normal driving operation, always carry out a pendulum movement in the direction of the forces of gravity. When suddenly changes in the vehicle speed occur, the sensor housing will, in view of the outer liquid cushioning maintain its inertia and the mass ball 101 will control the control pulse. At the bottom side of the sensor housing 89 an additional mass 102 may be provided for a better tuning, or adaptation. By determining the diameter of the cushioning housing, the maximum position of inclination 103 is determined, which maximum position of inclination is shown by dash lines.

Figure 3:
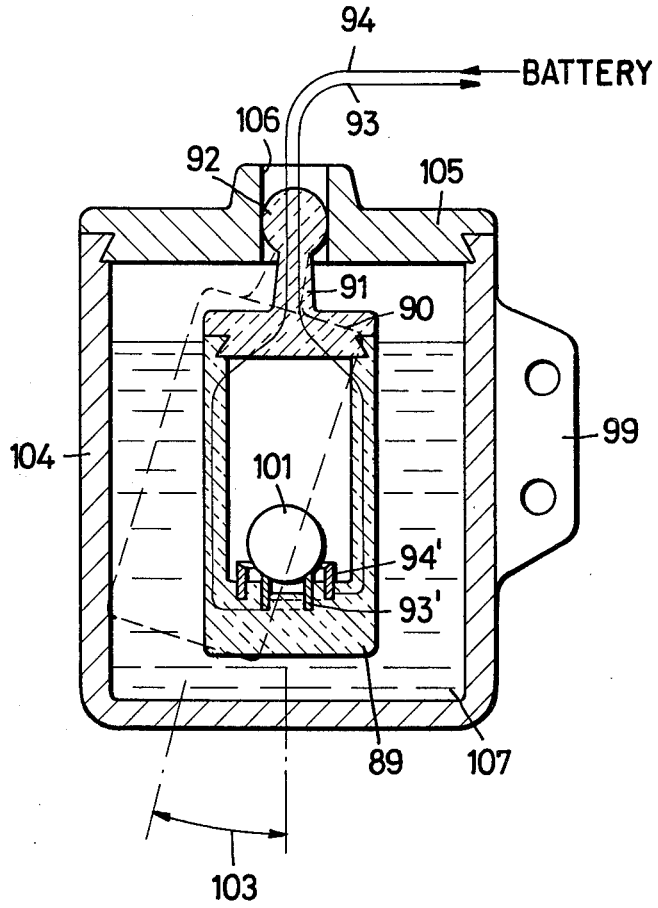
FIG. 3 is a vertical section through a modified control device according to the invention.

The embodiment of FIG. 3 is similar to that of FIG. 12 of copending parent application Ser. No. 368,972-Fohl filed June 11, 1973, but differs therefrom in that it has an outer liquid cushioning which is effective in all directions. The sensor corresponds to a major extent to that of FIG. 2. The cushioning housing 14 has a bottleneck-like snap cover 105. The bore 106 is slightly greater than the ball head 92 so that the sensor can be displaced axially. Moreover, the sensor can be pivoted in conformity with the angle 103. If a cushioning liquid 107 is filled into the container 104, housing 89 is subjected to a buoyancy and thus floats. In this way, an outer liquid cushioning is realized in all locations of operations of the device.

It is, of course, to be understood that the present invention is, by no means, limited to the particular embodiments illustrated in the drawings, but also comprises any modifications within the scope of the appended claims.

What is claimed is:

1. An acceleration and retardation responsive device comprising; housing means, a mass element in said housing means, a support member in said housing having an upwardly facing annular seat on the upper end thereof engaging said element in a region radially spaced from the vertical central axis of the element whereby said element is displaceable from said seat in response to a predetermined force of acceleration exerted between said seat and said element in any direction, and means operable in response to lateral movement of said element relative to said seat for actuating switch means adapted for connection in an external control circuit, and vertical damping means supporting said housing in a damped manner against vertical impacts.

2. A device according to claim 1 in which said support means comprises spring means supporting said housing for cushioned axial movement.

3. An acceleration and retardation responsive device comprising:

housing means, a mass element in said housing means in the form of a ball, a support member in said housing having an upwardly facing annular seat on the upper end thereof engaging said ball in a region radially spaced from the vertical central axis of the ball whereby said ball is displaceable from said seat in response to a predetermined force of acceleration exerted between said seat and said ball in any direction, and means operable in response to lateral movement of said ball relative to said seat for actuating switch means adapted for connection in an external control circuit, and support means moveably supporting said housing, said support means comprising means pivotally connected to an upper region of said housing on the axis thereof and above said seat and ball.

4. An acceleration and retardation responsive device comprising; housing means, a mass element in said housing means in the form of a ball, a support member in said housing having an upwardly facing annular seat on the upper end thereof engaging said ball in a region radially spaced from the vertical central axis of the ball whereby said ball is displaceable from said seat in response to a predetermined force of acceleration exerted between said seat and said ball in any direction, and means operable in response to lateral movement of said ball relative to said seat for actuating switch means adapted for connection in an electric control circuit, casing surrounding said housing, said housing being moveably supported in said casing, and damping liquid in said casing in which said housing is at least partly submerged.

5. A device according to claim 4 in which said casing has a top wall, said housing having a ball element at the top on the axis thereof, and a socket in the top wall of said casing swivelly receiving said ball element.

6. A device according to claim 5 in which said housing has a top wall press fitted thereon, said ball element being fixedly attached to the top wall of said housing.

7. A device according to claim 5 in which said ball element comprises elastic material.

8. A device according to claim 5 in which wires leading from the terminals of said switch means pass through said ball element in the axial direction of said housing.

9. A device according to claim 5 which includes an elastic cushioning ring supporting said top wall of said casing on said casing.

10. A device according to claim 5 in which said casing has a bottom wall and a peripheral wall upstanding from the bottom wall, said top wall closing the upper end of said casing, said socket being formed in the center of said top wall of the closing.

11. A device according to claim 10 in which the top wall of said casing is spring fitted into the upper end of said casing.

* * * * *